US009302176B2

(12) United States Patent
Alvite et al.

(10) Patent No.: US 9,302,176 B2
(45) Date of Patent: Apr. 5, 2016

(54) THREE-DIMENSIONAL PLAYING DEVICE AND METHOD OF USE

(71) Applicant: MINDWARE HOLDINGS, INC., Roseville, MN (US)

(72) Inventors: Teza Alvite, Plymouth, MN (US); Jonathan Staruck, White Bear Lake, MN (US); Adam Turner, Arden Hills, MN (US)

(73) Assignee: Mindware Corporation, Roseville, MN (US)

( * ) Notice: Subject to any disclaimer, the term of this patent is extended or adjusted under 35 U.S.C. 154(b) by 95 days.

(21) Appl. No.: 14/015,396

(22) Filed: Aug. 30, 2013

(65) Prior Publication Data

US 2014/0062017 A1 Mar. 6, 2014

Related U.S. Application Data

(60) Provisional application No. 61/696,091, filed on Aug. 31, 2012.

(51) Int. Cl.
*A63F 9/06* (2006.01)
*A63F 9/00* (2006.01)

(52) U.S. Cl.
CPC ..... *A63F 9/0641* (2013.01); *A63F 2009/0036* (2013.01); *A63F 2009/0039* (2013.01); *A63F 2009/0616* (2013.01); *A63F 2009/0638* (2013.01); *A63F 2009/0659* (2013.01); *A63F 2250/307* (2013.01)

(58) Field of Classification Search
CPC ..... A63F 9/0613; A63F 2009/0615; A63F 2009/0616; A63F 9/0641; A63F 2009/0661; A63F 2009/0665; A63F 2009/0638; A63F 2009/0629; A63F 2009/0618; A63F 2009/0036; A63F 2250/307; A63F 2009/0659; A63F 2009/0039
See application file for complete search history.

(56) References Cited

U.S. PATENT DOCUMENTS

| | | | | |
|---|---|---|---|---|
| 2,044,760 | A * | 6/1936 | Anderson | 434/85 |
| 2,280,609 | A * | 4/1942 | Williamson | 273/157 A |
| 4,620,770 | A * | 11/1986 | Wexler | 359/464 |
| 4,669,984 | A * | 6/1987 | Jones et al. | 434/85 |
| 4,799,680 | A * | 1/1989 | Weimar | 273/157 R |
| 5,577,728 | A * | 11/1996 | Kondo | 273/157 A |
| 5,649,028 | A * | 7/1997 | Hollinger | 382/199 |
| 6,213,465 | B1 * | 4/2001 | Jacoby | 273/157 R |
| 6,336,631 | B1 * | 1/2002 | Volkert | 273/157 R |

(Continued)

OTHER PUBLICATIONS

"3D Doodles", Jun. 24, 2009, pp. 1-2, [retrieved on Mar. 2, 2015], retrieved from the Internet <http//3ddoodles.com/>.*
"3D Doodles", Sep. 9, 2011, pp. 1-2, [retrieved on Mar. 2, 2015], retrieved from the Internet <www.3ddoodles.com/instructions.html>.*

(Continued)

*Primary Examiner* — Steven Wong
(74) *Attorney, Agent, or Firm* — Hamre, Schumann, Mueller & Larson, P.C.

(57) ABSTRACT

A three dimensional (3D) playing device includes a playing surface; a first anaglyph image displayed on the playing surface, the anaglyph image including a first and a second superimposed color layers that have a predetermined lateral offset, the first color layer including a first color, the second color layer including a second color, the first and second colors are different from each other; a plurality of prearranged dots displayed on the playing surface; and indicia indicating a predetermined sequence to connect the dots. The first anaglyph image forms a background or a foreground for an image revealed by connecting the dots.

15 Claims, 11 Drawing Sheets

(56) References Cited

U.S. PATENT DOCUMENTS

| | | | | |
|---|---|---|---|---|
| 6,389,236 | B1 * | 5/2002 | Western | 396/324 |
| 2006/0098282 | A1 * | 5/2006 | McCart et al. | 359/472 |
| 2006/0108734 | A1 * | 5/2006 | Ustarbowski et al. | 273/157 R |
| 2011/0080399 | A1 * | 4/2011 | Sgromo | 345/419 |

OTHER PUBLICATIONS

"Holiday cards for sale now and free with purchase!", Dec. 14, 2010, pp. 1-6, [retrieved on Mar. 2, 2015], retrieved from the Internet <http://www.leethal.net/zine/?p=1284>.*

* cited by examiner

THREE-DIMENSIONAL PLAYING DEVICE AND METHOD OF USE

This application claims the benefit of U.S. Provisional Applicant Ser. No. 61/696,091 , filed on Feb. Aug. 31, 2012, entitled THREE-DIMENSIONAL PLAYING DEVICE AND METHOD OF USE, the entire contents of which are incorporated herein by reference.

FIELD

This disclosure relates generally to puzzles and puzzle games. More particular, this disclosure relates to a puzzle device that creates three dimensional (3D) effects and methods of using the device.

BACKGROUND

Puzzles and puzzle games are popular among both children and adults because they have an artistic and educational appeal as well as an intellectual challenge. Connect-the-dots is a type of puzzle games that includes a sequence of numbered dots. When a line is drawn to connect the dots according to a predetermined sequence, an outline of an image is revealed. Connect-the-dots games allow players to guess the image that is being gradually revealed before it is completed. This type of game often includes simple line art to identify the resulting image or to render a complex section of the image to be identified clearly.

SUMMARY

This disclosure relates generally to puzzles and puzzle games. More particular, this disclosure relates to a puzzle device that creates 3D effects and methods of using the device.

Specifically, the embodiments described herein are directed to a 3D playing device that includes a play surface, at least one anaglyph image displayed on the play surface, a plurality of prearranged dots, and indicia indicating a predetermined sequence to connect the dots. The anaglyph image helps provide a background or foreground for an image gradually revealed by connecting the dots, thereby enhancing the artistic appeal of the playing device.

In one embodiment, a 3D playing device includes a playing surface; a first anaglyph image displayed on the playing surface, the anaglyph image including a first and a second superimposed color layers that have a predetermined lateral offset, the first color layer including a first color, the second color layer including a second color, the first and second colors are different from each other; a plurality of prearranged dots displayed on the playing surface; and indicia indicating a predetermined sequence to connect the dots. The first anaglyph image forms a background or a foreground for an image revealed by connecting the dots.

In another embodiment, a method for instructing a user to use a 3D playing device that includes at least one anaglyph image includes providing a playing surface including at least one anaglyph image; providing a plurality of prearranged dots on the playing surface; providing indicia indicating a predetermined sequence to connect the dots; instructing a user to connect the dots with a temporary marking device according to the predetermined sequence indicated by the indicia, thereby revealing an image; instructing the user to trace over the outline with a permanent marking device to complete the image revealed by connecting the dots; and instructing the user to wear colored filter glasses to view 3D effects of the 3D playing device, where the anaglyph image forms a background or foreground for the image revealed by connecting the dots.

In a further embodiment, a 3D playing kit includes a book including a plurality of playing surfaces. At least one playing surface has at least one anaglyph image displayed thereon, the anaglyph image including a first and a second superimposed color layers that have a predetermined lateral offset, the first color layer including a first color, the second color layer including a second color, the first and second colors are different from each other; and a plurality of prearranged dots displayed thereon; indicia indicating a predetermined sequence to connect the dots; a pair of colored filter glasses for viewing the anaglyph image, the colored filter glasses including a first colored filter and a second colored filter, corresponding to the first and second colors of the anaglyph image, respectively; a permanent marking device; a carrying case having a storage volume sized to enclose therewithin and allow removal therefrom at least the pair of colored filter glasses; and a set of instructions that instruct a user how to connect the plurality of prearranged dots to reveal an image. The at least one anaglyph image forms a background or foreground for the image revealed by connecting the dots.

This Summary is an overview of some of the teachings of the present application and not intended to be an exclusive or exhaustive description of the claimed invention. Further details about the present subject matter are found in the detailed description and appended claims. Other aspects of the subject matter will be apparent to persons skilled in the art upon reading and understanding the following detailed description and viewing the drawings that form a part thereof, each of which are not to be taken in a limiting sense. The scope of the claimed invention is defined by the appended claims and their equivalents.

DESCRIPTION OF THE DRAWINGS

The drawings, which are not necessarily drawn to scale, illustrate generally, by way of example, but not by way of limitation, various embodiments discussed in this application.

DETAILED DESCRIPTION

This disclosure relates generally to puzzles and puzzle games. More particular, this disclosure relates to a puzzle device that creates 3D effects and methods of using the device.

Specifically, the embodiments described herein are directed to a 3D playing device that includes a play surface, at least one anaglyph image displayed on the play surface, a plurality of prearranged dots, and indicia indicating a predetermined sequence to connect the dots. The anaglyph image helps provide a background or foreground for an image gradually revealed by connecting the dots, thereby enhancing the artistic appeal of the playing device.

References are made to the accompanying drawings that form a part hereof, and in which is shown by way of illustration of the embodiments in which the devices and methods described herein may be practiced. The term "anaglyph" refers to an image consisting of two slightly different perspectives (for example, right and left eye views) of a same object in different colors that are superimposed on each other, producing a 3D effect when viewed through two correspondingly colored filters.

The terms "above," "on," "under," "top," "bottom," "up," "down," "horizontal," and "vertical" and the like used herein are in reference to the relative positions of the playing device, the playing kit, and their constituent parts, in use when oriented as in FIGS. 1A-F and 2-10.

Figure 1A:
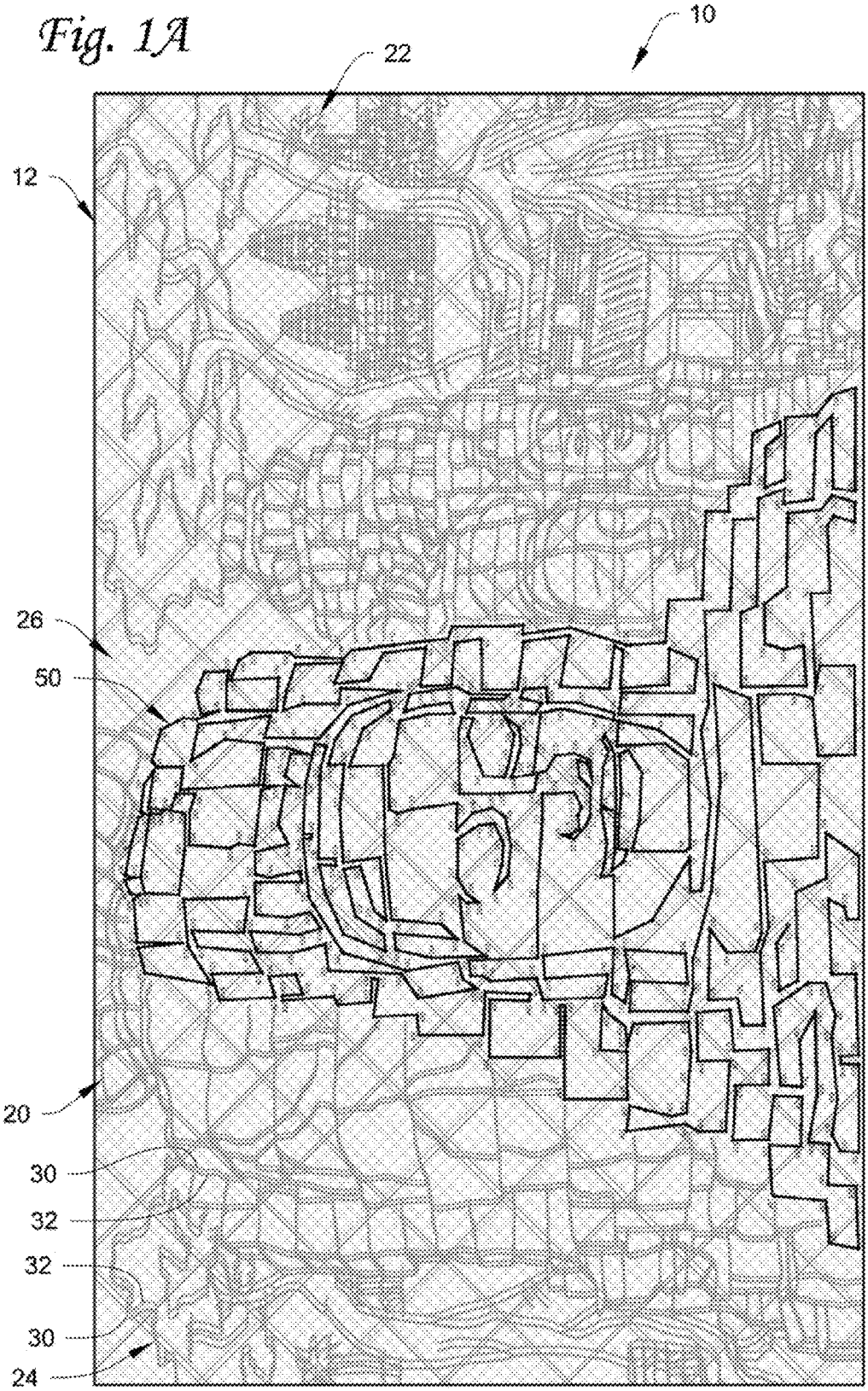
FIG. 1A illustrates an embodiment of a 3D playing device after the dots being connected.
Figure 1B:
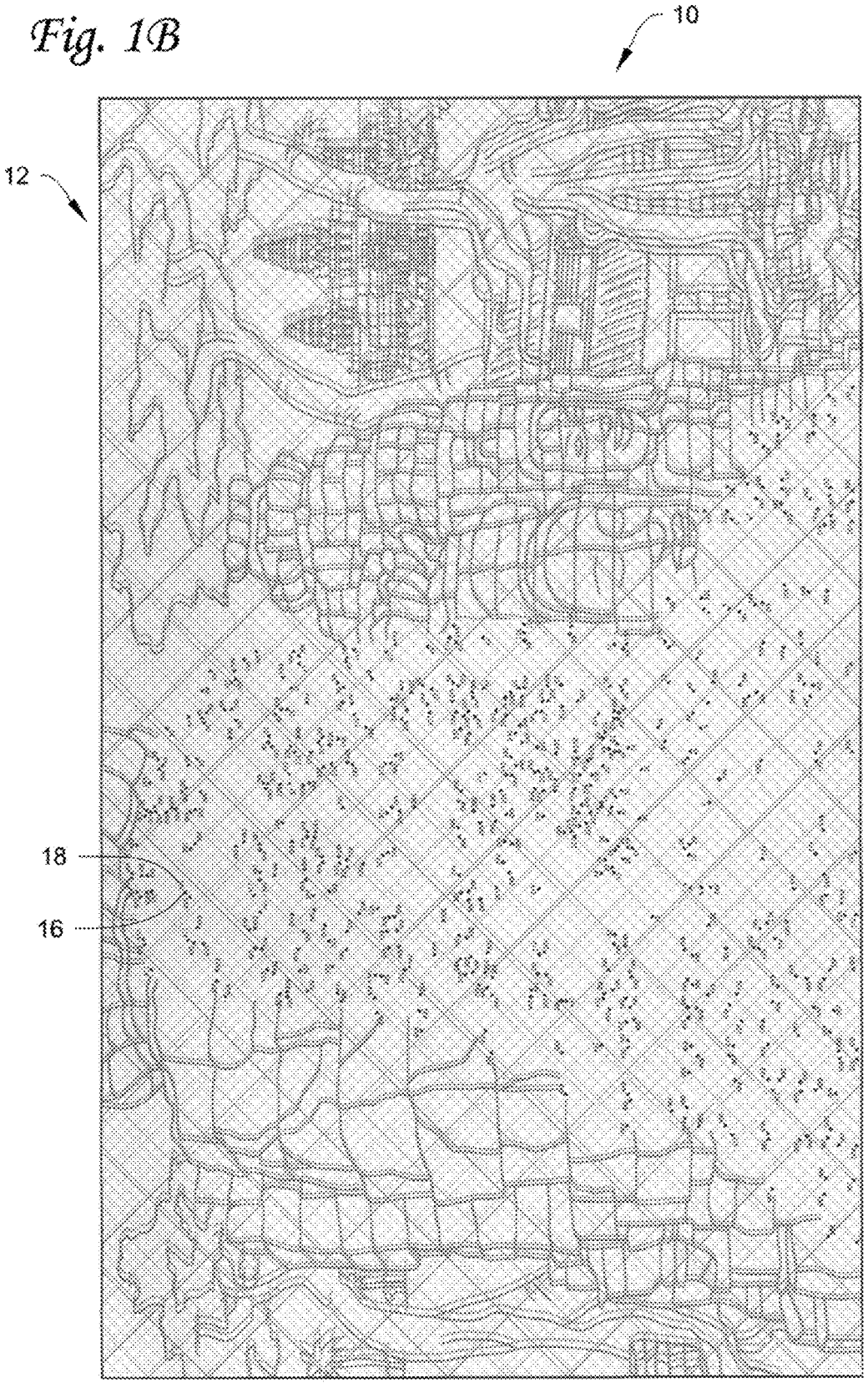
FIG. 1B illustrates the 3D playing device of FIG. 1A, before the dot being connected.
Figure 1C:
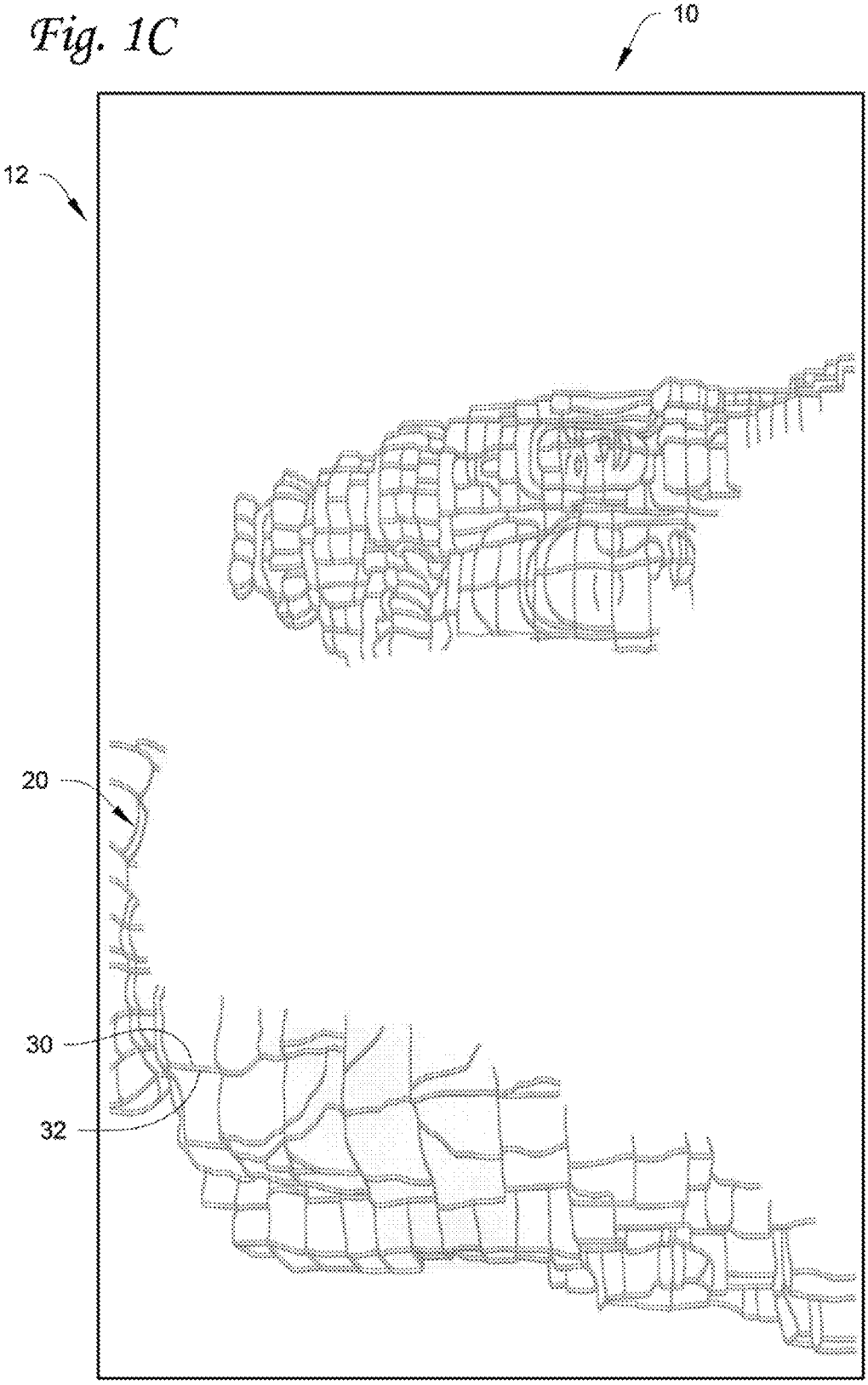
FIG. 1C illustrates a first anaglyph image of the 3D playing device of FIG. 1A.
Figure 1D:
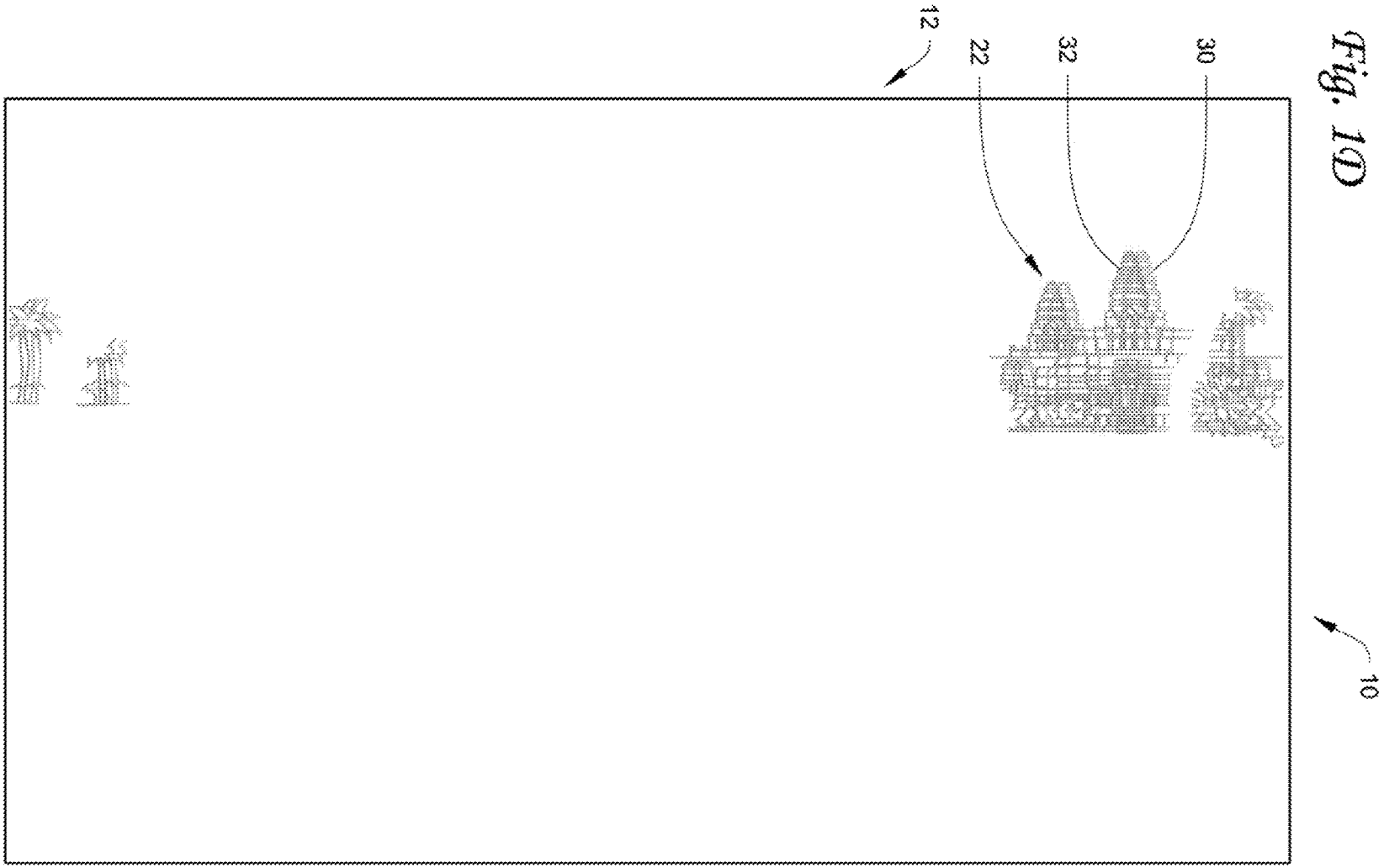
FIG. 1D illustrates a second anaglyph image of the 3D playing device of FIG. 1A.
Figure 1E:
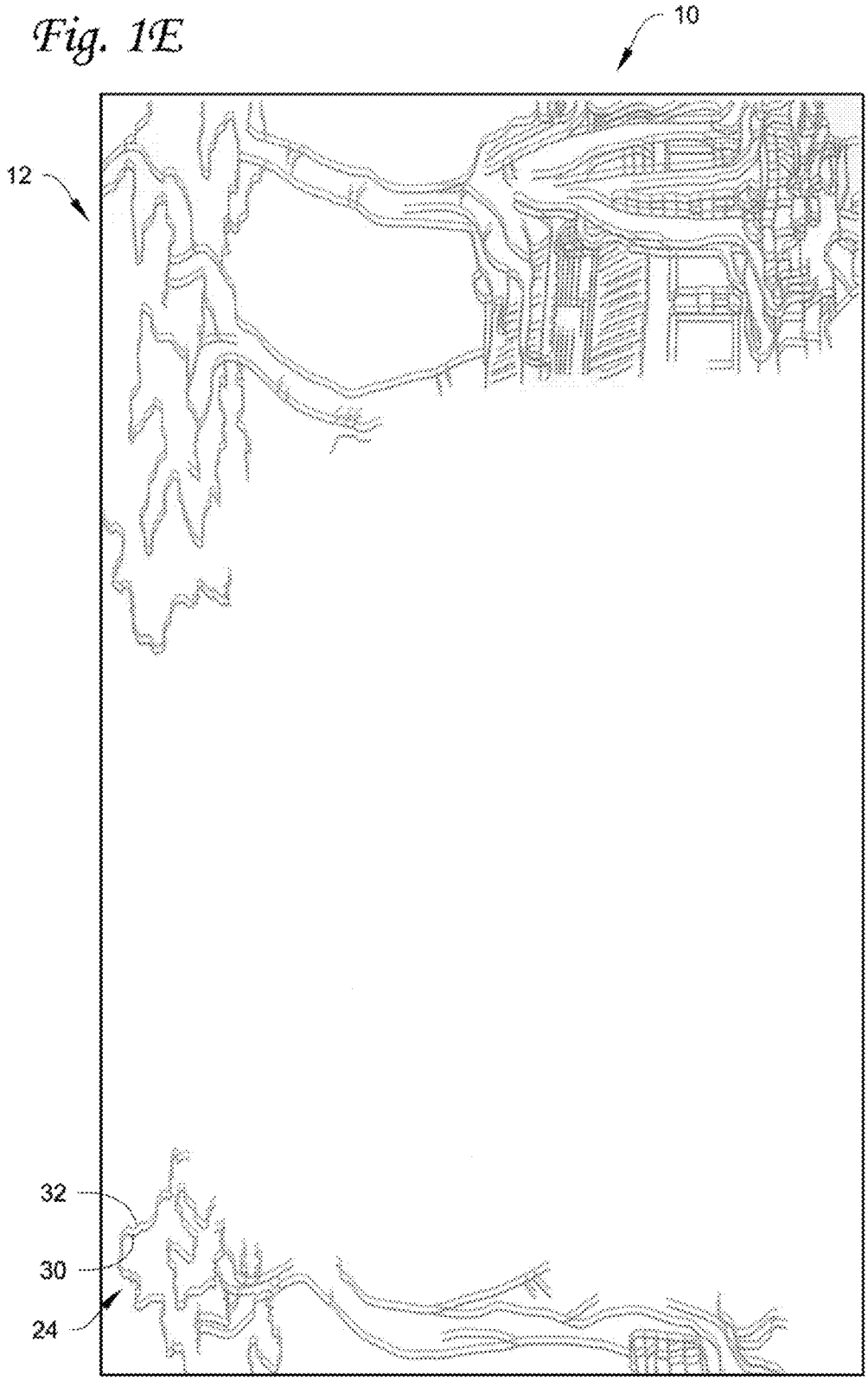
FIG. 1E illustrates a third anaglyph image of the 3D playing device of FIG. 1A.

With reference to FIGS. 1A-F and 3, a 3D playing device 10 includes a playing surface 12 capable of receiving and displaying information, including colors, shapes, size, and images, and colored filter glasses 14 for viewing stereoscopic 3D effects of images displayed on the playing surface. The playing surface 12 shows at least one anaglyph image 20, a plurality of prearranged dots 16, and indicia 18 that indicates a predetermined sequence to draw a line to connect the dots. In one embodiment, the playing surface 12 is a paper playing surface. In an alternative embodiment, the playing surface is an electronic display playing surface. With reference to FIG. 1C, a first anaglyph image 20 is displayed on the playing surface 12. A second anaglyph image 22 is displayed on an outer side of the first anaglyph image 20, as shown in FIGS. 1A-B and D, and a third anaglyph image 24 is also displayed on the playing surface 12, as shown in FIGS. 1A-B and E.

Figure 1F:
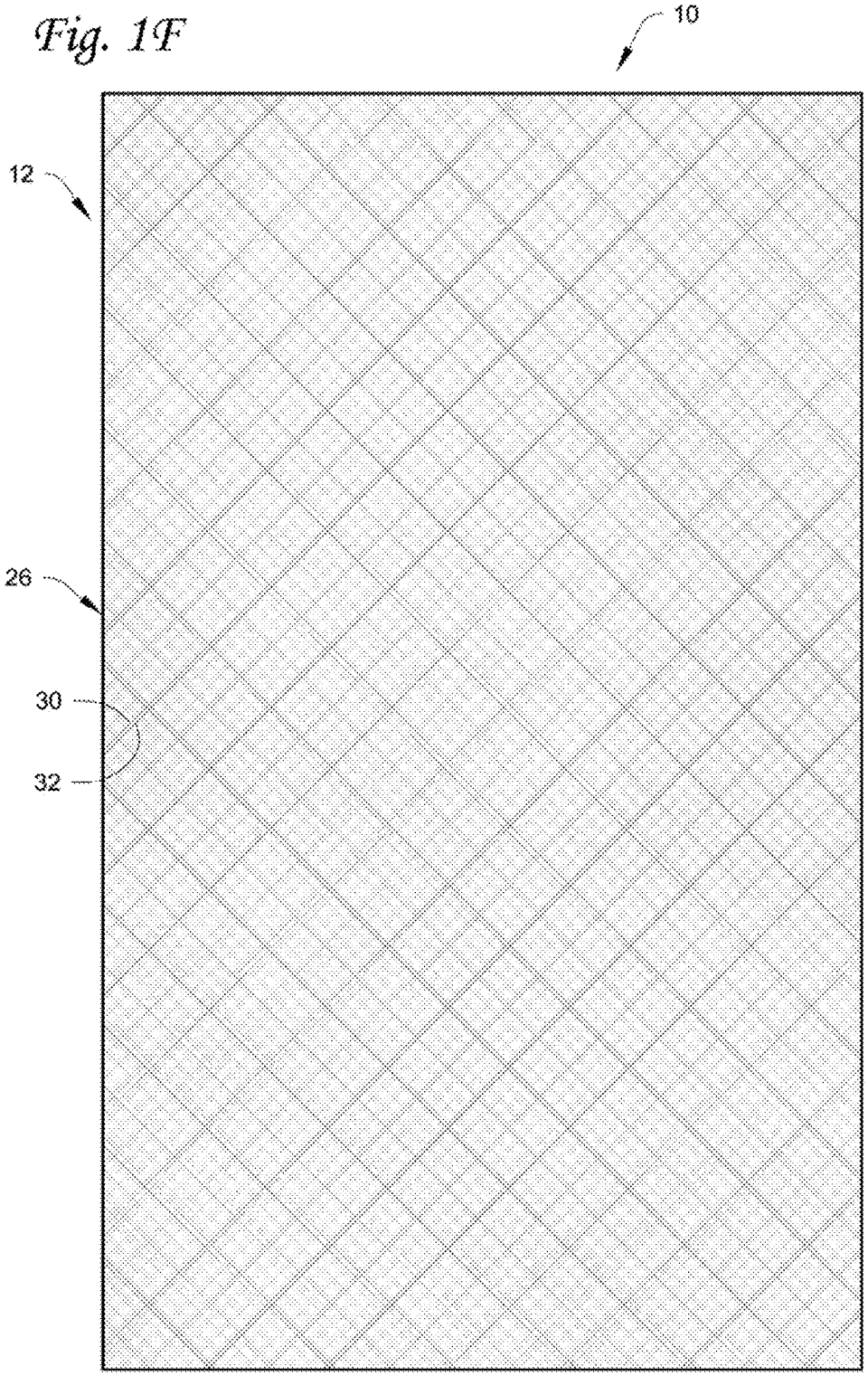
FIG. 1F illustrates a base anaglyph image of the 3D playing device of FIG. 1A.

In one embodiment, a base anaglyph image 26 that includes a repeated pattern is also displayed on the playing surface 12. The base anaglyph image 26 helps provide a more solid background and as a result, helps enhance the 3D effects of the playing device 10. In the exemplary embodiment as shown in FIGS. 1A-B and 1F, the base anaglyph image 26 includes a diagonal grid pattern having lines oriented at 45 degrees with respect to a horizontal direction. The line spacing in the diagonal grid pattern is 1.5 mm and the line weight in the diagonal grid pattern is 0.1 mm. It is to be understood that the orientation of the lines in the grid pattern and the spacing of the lines in the grid pattern can vary as desired. It is also to be understood that the base anaglyph image can include any types of pattern, such as waffled pattern, honeycomb pattern, etc.

As illustrated in FIGS. 1A-E, each anaglyph image 20, 22, 24, 26 displayed on the playing surface is made up of a first color layer 30 and a second color layer 32 which are superimposed but offset with respect to each other to create an illusion of depth. The first and second color layers 30, 32 are offset laterally, corresponding to the lateral offset of a viewer's left and right eyes, respectively. When viewing through the colored filter glasses 14, the anaglyph image contains two differently filtered colored images, one for each eye. The anaglyph image allows a left eye to see only the first color layer 30, and the right eye to see only the second color layer 32. The offset between the two color layers 30, 32 in the left and right eyes, respectively, provides an illusion of a parallax, and as a result, create the illusion of depth. The sense of perspective with respect to the playing surface 12 is produced by the degree of offset of the two colored layers 30, 32 viewed by the two eyes. The greater the degree of offset, the more distant the image is viewed with respect to the playing surface 12.

With reference to FIGS. 1A-C, the first anaglyph image 20 is viewed as having a first distance behind the playing surface 12. With reference to FIGS. 1A-B and D, the second anaglyph image 22 is viewed as having a second distance that is greater than the first distance 34 behind the playing surface 12. With reference to FIGS. 1A-B and E, the third anaglyph image 24 is viewed as having a third distance ahead of the playing surface 12. With reference to FIGS. 1A-E, the first and second anaglyph images 20, 22 form a background for the playing surface 12, and the third anaglyph image 24 forms a foreground for the playing surface 12. With reference to FIGS. 1A-B and F, the base anaglyph image 26 is viewed as having a fourth distance behind the playing surface 12, and also forms a part of the background for the playing surface 12.

Each anaglyph image 20, 22, 24, 26 is produced by drawing each anaglyph image in a first color, for example, red, as the first color layer 30, and then drawing a second reproduction of each image in a second color, for example, blue, as the second color layer 32, which is on top of and offset laterally to the left of the red image by a predetermined distance. As a result, the parallax provides the desired illusion of depth, between each anaglyph image 20, 22, 24 and 26, and the playing surface 12. As shown in FIGS. 1A-B and E, the third anaglyph image 24 appears closer than the playing surface 12. In such a case, the red outline in the first color layer 30 is offset, for example, to the left of the blue outline in the second color layer 32; while in the images which are to appear behind the playing surface 12, the red outline in the first color layer 30 is drawn to the right of the blue outline in the second color layer 32. That is, the first and second color layers 30, 32 in a background anaglyph image and in a foreground anaglyph image are shifted laterally in opposite directions. By varying the degree of parallax, various images, for example, the first, second and third anaglyph images 20, 22, 24, and the base anaglyph image 26 can be made to appear at different distances behind or ahead of the playing surface 12. The largest offset produces the greatest impression of depth. For example, among the first, second, third anaglyph images 20, 22, 24 and the base anaglyph image 26, the largest offset between the first and second color layers 30, 32 occurs in the second anaglyph image 22. This largest offset produces the greatest distance between the second anaglyph image 22 and the playing surface 12.

Anaglyph images can be viewed with any stereoscopic viewing technology such as colored filter glasses, polarized filter glasses, side-by-side viewers, etc. In the exemplary embodiment as shown in FIGS. 2-5, colored filter glasses 14 are provided to view the anaglyph images. Typically, colored filter glasses 14 have a red filter 42 contained within a left eye opening of the colored filter glasses and a blue filter 44 contained within a right eye opening. The filters 42, 44 operate as a lens through which the user will view the anaglyph images 20, 22, 24, 26 contained on the playing surface. The red filter 42 allows only the blue part of the image through to the left eye while the blue filter 44 allows only the red part of the image through to the right eye. Each eye therefore sees a slightly different perspective of the image. The brain blends together the images it receives from each eye and interprets the differences as being the result of different distances. It is to be understood that other colors can be used for the filters 42, 44 as desired.

When the two-color anaglyph is viewed through the colored filter glasses 14 having one red filter 42 and one blue filter 44, the viewer's left eye will see only the red outline in the first color layer 30 and the viewer's right eye will see only the blue outline in the second color layer 32, and the varying degree of parallax between the images in the first and second color layers seen by the two eyes produces the illusion of depth or perspective.

With reference to FIG. 1B, the plurality of prearranged dots 16 are arranged such that when the user draws a line from a dot to a dot according to a predetermined rule, an image 50 is gradually revealed. In one embodiment, the predetermined rule is expressed by consecutively sequenced indicia 18, for example, numbers or letters, to indicate the sequence on how the plurality of dots 16 are to be connected. In one embodiment, the image 50 made by connecting all the dots 16 is an image of a complete object. In another embodiment, colors can be filled in the image 50 to enhance the artistic appeal of the image. In one embodiment, colors filled in the image 50 can help reinforce the 3D effect. In the exemplary embodiment as shown in FIG. 1B, the plurality of prearranged dots 16 are located in a center portion of the playing surface 12. However, it is to be understood that the plurality of dots can be located in other locations on the playing surface 12 as desired.

With reference to FIGS. 2-6, a playing kit 100 includes a bound book 110 having a plurality of playing surfaces 12, a carrying case 120 containing colored filter glasses 14 and a permanent marking device 130, and a set of instructions on how to use the playing kit 100. In one embodiment, the playing kit 100 also includes a temporary marking device, for example, one or more soft black pencils, an eraser and a pencil sharpener. In one embodiment, the playing kit 100 also includes markers of colors for filling colors in the image 50 revealed by connecting the dots 16.

Figure 5:
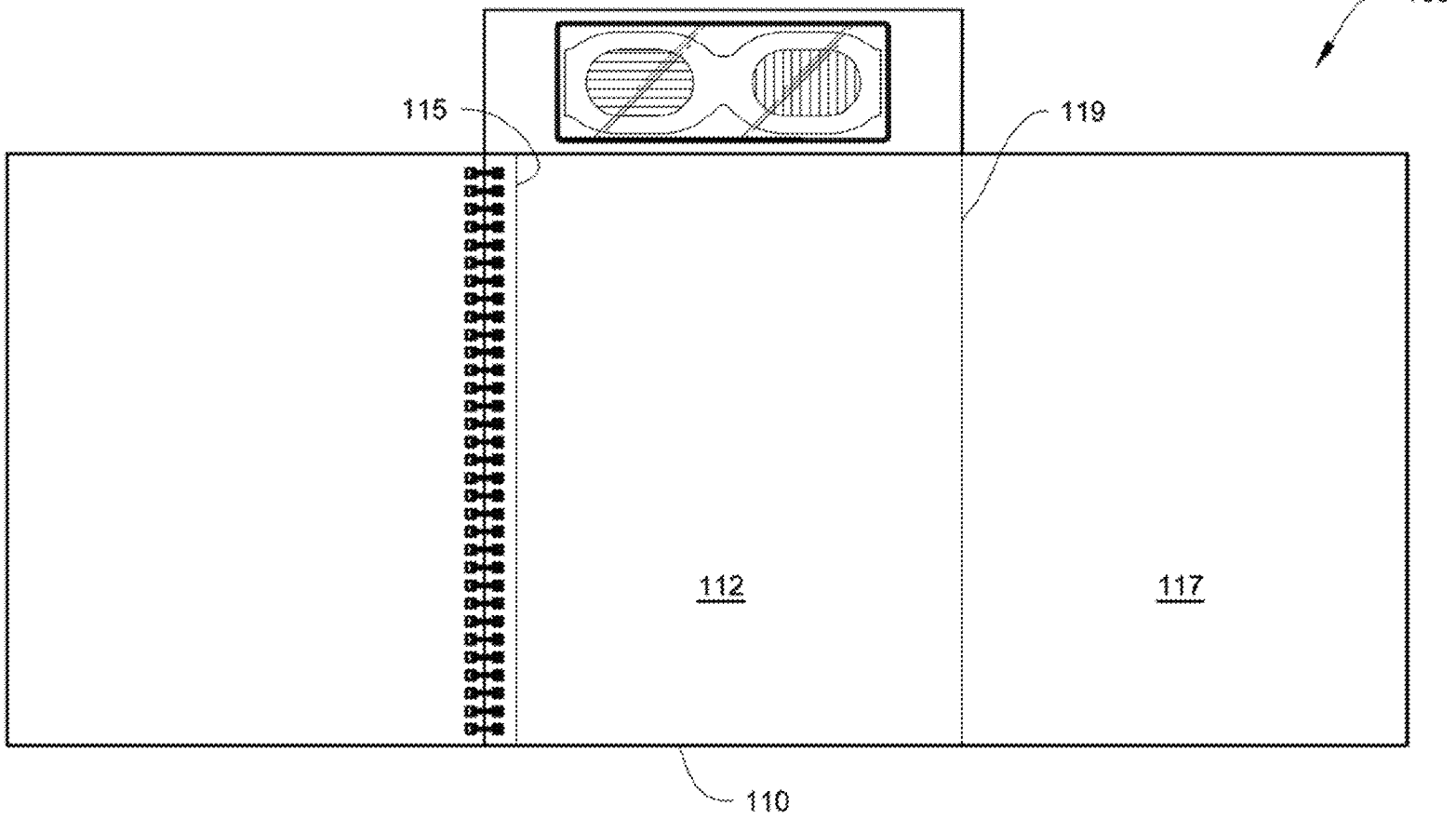
FIG. 5 illustrates the 3D playing kit of FIG. 3, with the book being opened, showing a fold-out sheet.
Figure 6:
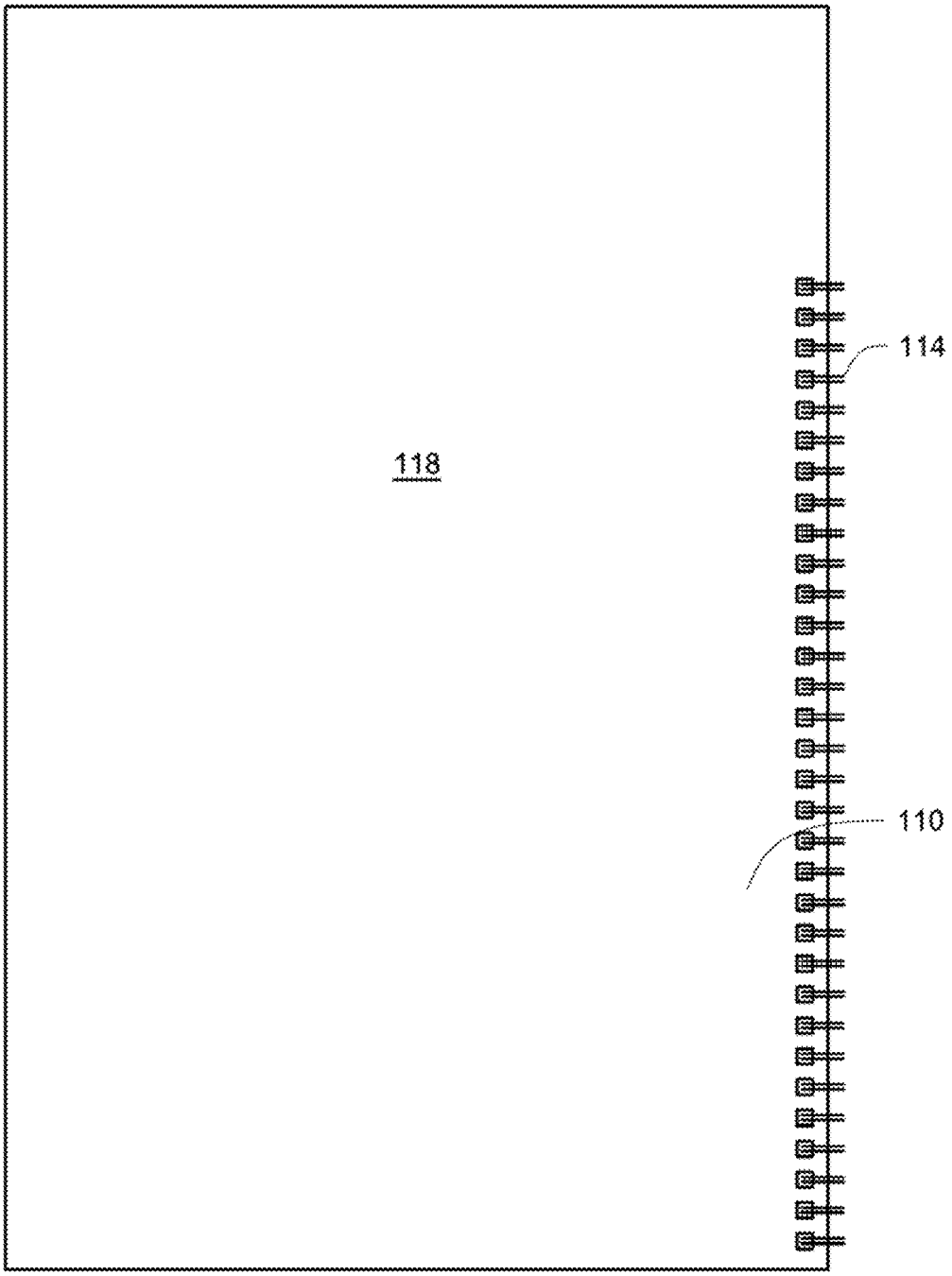
FIG. 6 illustrates the 3D playing kit of FIG. 3, showing an outer side of the back cover.

As shown in FIGS. 2-6, the bound book 110 includes a front cover 116, a back cover 118 and a plurality of sheets 112 disposed between the front and back covers 116, 118. Each sheet 112 includes at least one playing surface 12. The sheets 112 of the bound book can be normal book paper, for example, 100 gsm wood free paper. In the exemplary embodiment as illustrated in FIGS. 2-6, each sheet 112 includes a weakened area 115, for example, taking the form of score lines, score-slit lines, perforation lines, or the like to allow sheet 112 to be manually detached from the bound book 100 along a longitudinal edge of the sheet 112. The bound book 110 also includes a binding mechanism 114. In the exemplary embodiment illustrated in FIGS. 2-6, the binding mechanism 114 includes spiral binding, thereby allowing the sheets to rotate substantially around the entire binding. In an alternative embodiment, other types of binding mechanism can be used, such as, but not limited to, stapled binding, glued binding, ring binding, coil binding, wire binding, thermal binding, stitched binding, etc. In still another embodiment, the binding can be selected to allow sheets to be added to or removed from the bound book, such as by using openable metal or plastic rings inserted through holes in a book page. In a further embodiment, the plurality of sheets 112 are not bound, but merely maintained in a packaging or container in a loose sheet form. In the exemplary embodiment as shown in FIG. 5, the bound book 110 includes a fold-out sheet 117 to provide a larger playing surface 12. Each fold-out sheet 117 can be folded along a fold line 119.

Figure 2:
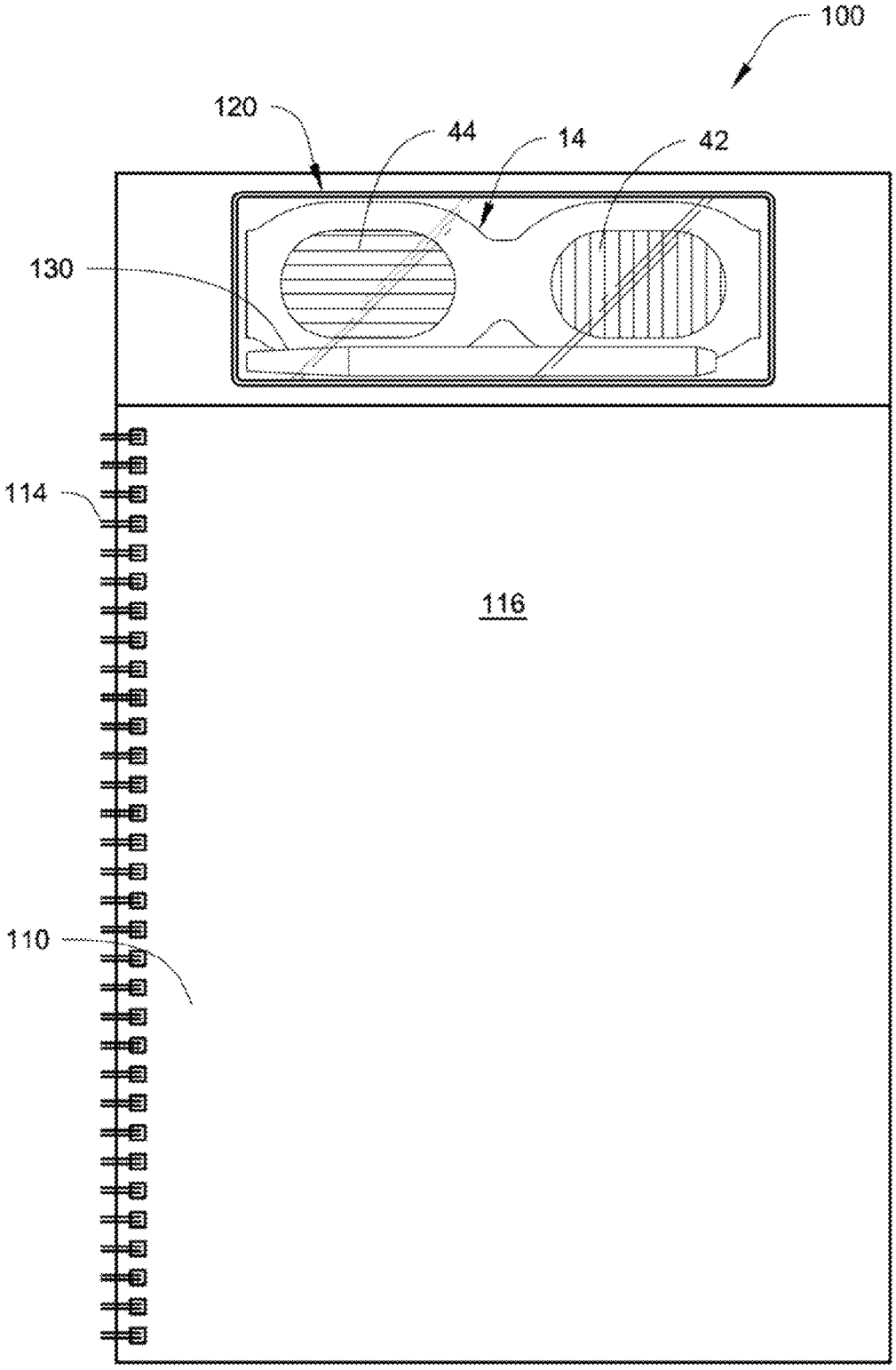
FIG. 2 illustrates an embodiment of a 3D playing kit including a plurality of playing surfaces.
Figure 3:
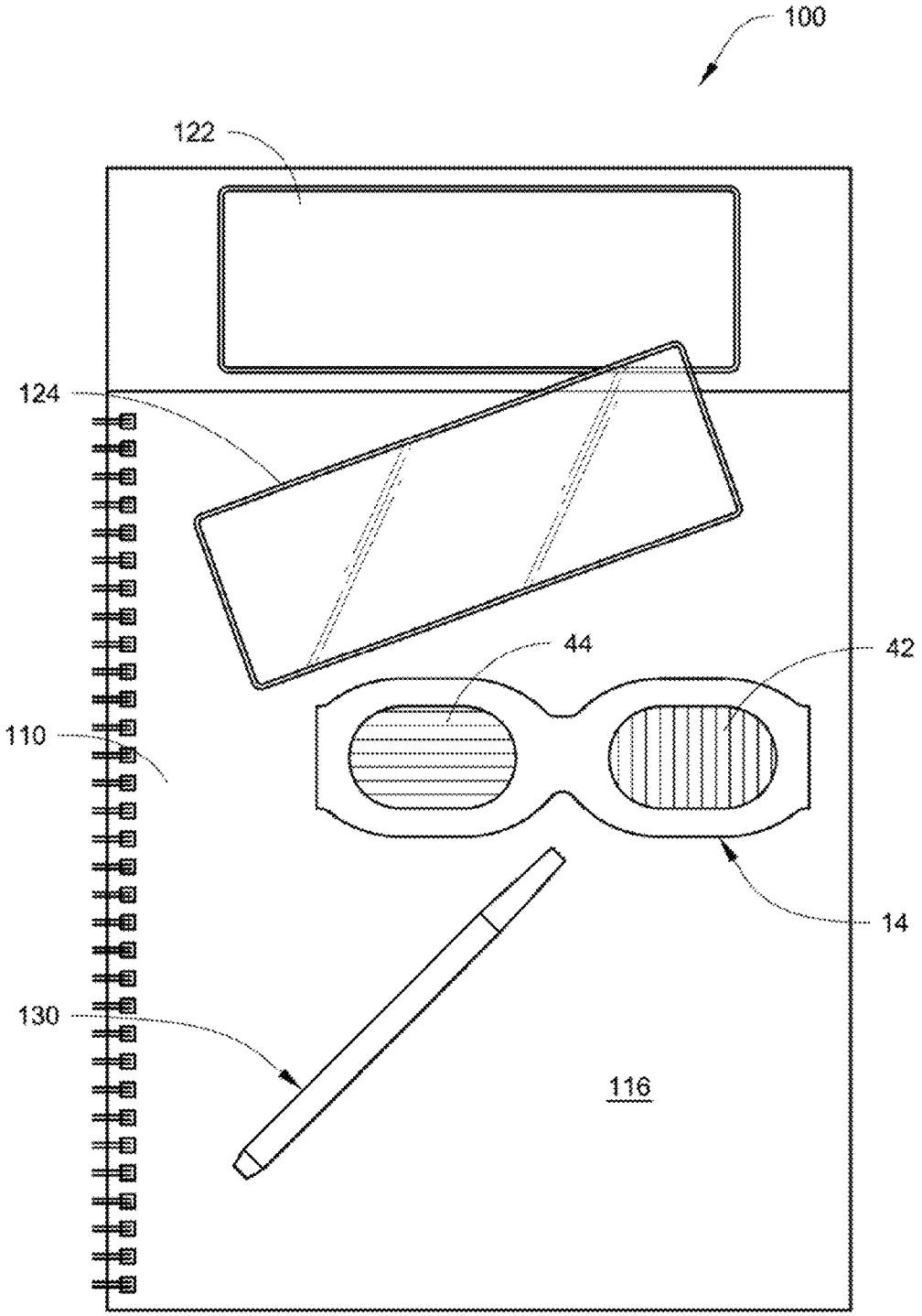
FIG. 3 illustrates the 3D playing kit of FIG. 3, with a carrying case being opened.
Figure 4:
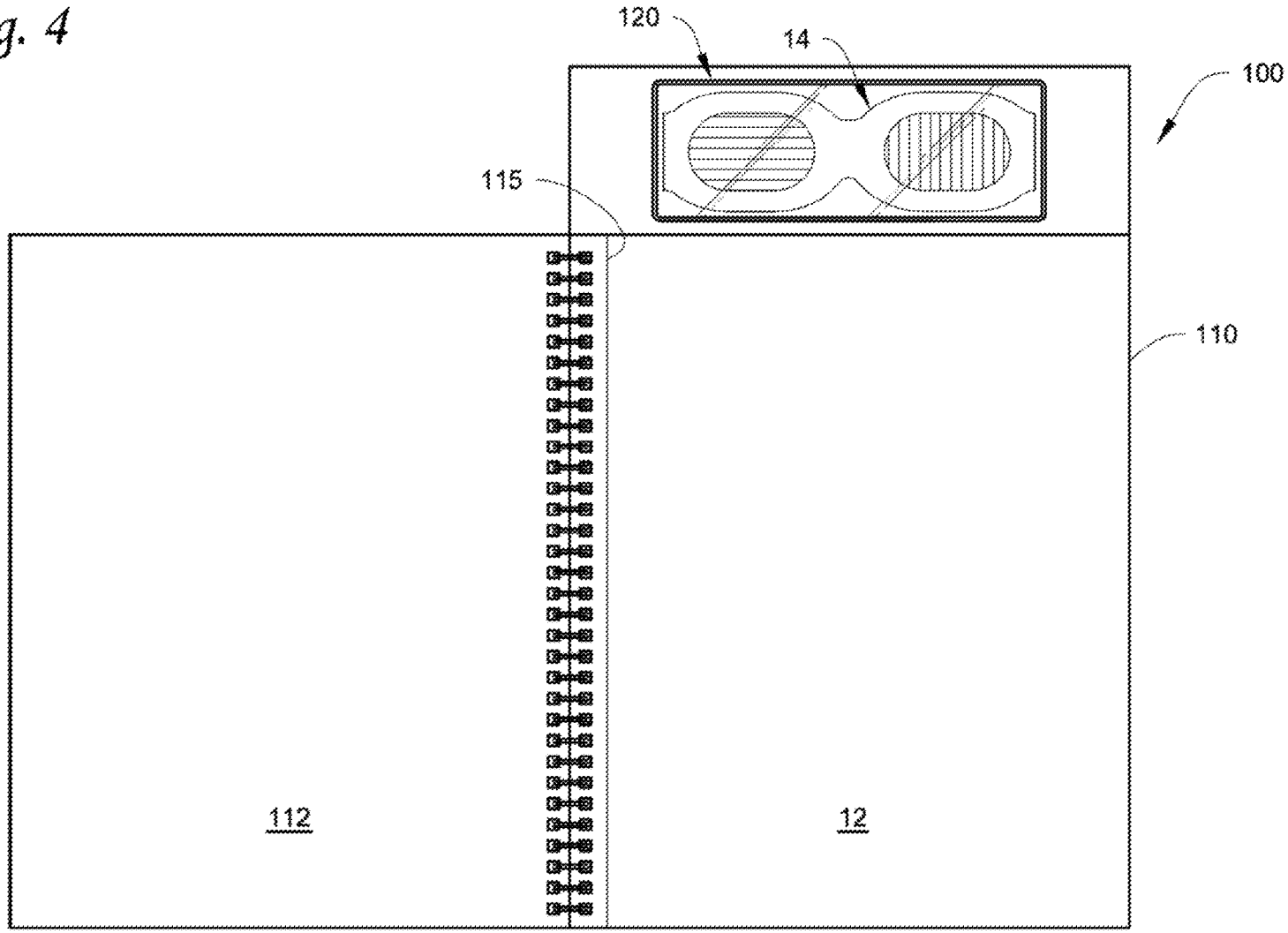
FIG. 4 illustrates the 3D playing kit of FIG. 3, with a book being opened, showing playing surfaces.

As shown in FIGS. 2-6, the carrying case 120 has a storage volume sized to enclose therewithin and allow removal therefrom at least colored filter glasses 14, and possibly marking devices, for example, the permanent marking device 130. The carrying case 120 is in a rectangular shape, including a base 122 and a removable clear cover 124, where the base 122 is made of substantially rigid plastic material through either a vacuum or injection mold process, and the removable clear cover 124 is made of plastic or polyethylene. The removable clear cover 124 is retained to the base 122 by interference fit, and can be lifted by grasping the cover between a user's thumb and fingers. The carrying case 120 is configured to allow the clear cover 124 to be put back on the base 122 and secured to the base 122 after use. It is to be understood that the carrying case 120 can be in other shapes and can be made of other materials as long as it can releasably contain the colored filter glasses or other accessories. The carrying case 120 is retained to an inner side of the back cover 118 of the bound book 110 by a retention mechanism. In the exemplary embodiment as shown in FIGS. 2-6, the carrying case 120 is retained to the back cover 118 by double-stick tape. Also, in the exemplary embodiment as shown in FIGS. 2-6, the carrying case 120 is retained on the inner side of the back cover 118 along a top edge of the back cover 118. When the playing kit 100 is displayed for retail, the carrying case 120 and the colored filter glasses contained therein are visible to the consumer, as shown in FIG. 2.

As shown in FIGS. 2-6, a permanent marking device 130 is a dark pen or dark marker that can produce a stroke that has a stroke weight that is equal to or greater than a stroke of the background or foreground anaglyph images to facilitate the viewer's eyes to focus on the image 50 revealed by connecting the dots 16. In one embodiment, the permanent marking device 130 is a dark felt-tip pen.

In some embodiments, the playing kit can further include a set of instructions contain suggestions as to the manner how the plurality of dots 16 are connected. The instructions instruct the user to first connect the dots 16 based on the indicia 18 with light pencil lines, and then trace over the pencil line with the dark marker. In one embodiment, the instructions can be provided as part of the bound book 110. In an alternative embodiment, the instructions can be provided as part of the product packaging.

The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A three dimensional (3D) playing device, comprising:

a playing surface;

a composed image displayed on the playing surface, the composed image comprising a first and a second superimposed color layers, first color layer including a first color, the second color layer including a second color, the first and second colors being different from each other, the composed image including:

a first anaglyph image displayed on the playing surface, the first anaglyph image including the first and the second superimposed color layers that have a first predetermined lateral offset; and a base anaglyph image including a grid pattern, the grid pattern including the first and the second superimposed color layers that have a further predetermined lateral offset, the further predetermined lateral offset of the base anaglyph image being different from the first predetermined lateral offset of the first anaglyph image;

a plurality of prearranged dots displayed on the playing surface;

indicia indicating a predetermined sequence to connect the dots; and a pair of colored filter glasses, wherein the colored filter glasses includes a first colored filter and a second colored filter, the first colored filter and second filter allow a viewer to see the first color layer and the second color layer of the anaglyph image, respectively, wherein the composed image forms a background or a foreground for an image revealed by connecting the dots.

2. The 3D playing device of claim 1, wherein the composed image further comprises: a second anaglyph image including the first and the second superimposed color layers that have a second anaglyph image the second predetermined lateral offset of the second anaglyph image is greater than the first predetermined lateral offset of the first anaglyph image, wherein the second anaglyph image is viewed as having a greater distance with respect to the playing surface than the first anaglyph image.

3. The 3D playing device of claim 1, wherein the composed image further comprises: a third anaglyph image including the first and the second supersimposed color layers that have a third anaglyph image the first predetermined offset of the first anaglyph image and the third predetermined offset between first and a second color layers of the third anaglyph image are shifted laterally in opposite directions, thereby allowing the first anaglyph image to form a background for the image revealed by connecting the dots and the third anaglyph image to form a foreground for the image revealed by connecting the dots.

4. The 3D playing device of claim 1, wherein the image revealed by connecting the plurality of prearranged dots is an image of a complete object.

5. The 3D playing device of claim 1, wherein the playing surface is a paper playing surface.

6. The 3D playing device of claim 1, wherein the playing surface is an electronic playing surface.

7. The 3D playing device of claim 1, wherein when viewed, the image revealed by connecting the dots has a different distance with respect to the playing surface than the first anaglyph image.

8. A method for instructing a user to use a three dimensional (3D) playing device that includes a playing surface , comprising:

providing a composed image on the playing surface, the composed image comprising a first and a second superimposed color layers, first color layer including a first color, the second color layer including a second color, the first and second colors being different from each other, the composed image including:

a first anaglyph image displayed on the playing surface, the first anaglyph image including the first and the second superimposed color layers that have a first predetermined lateral offset; and a base anaglyph image including a grid pattern, the grid pattern including the first and the second superimposed color layers that have a further predetermined lateral offset, the further predetermined lateral offset of the base anaglyph image being different from the first predetermined lateral offset of the first anaglyph image;

providing a plurality of prearranged dots on the playing surface;

providing indicia indicating a predetermined sequence to connect the dots;

instructing a user to connect the dots with a temporary marking device according to the predetermined sequence indicated by the indicia, thereby revealing an image;

instructing the user to trace over the outline with a permanent marking device to complete the image revealed by connecting the dots; and instructing the user to wear colored filter glasses to view 3D effects of the 3D playing device, where the composed image forms a background or foreground for the image revealed by connecting the dots.

9. A three dimensional (3D) playing kit, comprising:

a book including a plurality of playing surfaces, at least one of the plurality of the playing surfaces including:

a composed image comprising a first and a second superimposed color layers, first color layer including a first color, the second color layer including a second color, the first and second colors being different from each other, the composed image including:

a first anaglyph image displayed on the at least one of the plurality of playing surfaces, the first anaglyph image including the first and the second superimposed color layers that have a first predetermined lateral offset; and a base anaglyph image including a grid pattern, the grid pattern including the first and the second superimposed color layers that have a further predetermined lateral offset, the further predetermined lateral offset of the base anaglyph being different from the first predetermined lateral offset of the first anaglyph image; and a plurality of prearranged dots displayed thereon;

indicia indicating a predetermined sequence to connect the dots;

a pair of colored filter glasses for viewing the composed image, the colored filter glasses including a first colored filter and a second colored filter, corresponding to the first and second colors of the composed image, respectively;

a permanent marking device;

a carrying case having a storage volume sized to enclose therewithin and allow removal therefrom at least the pair of colored filter glasses; and a set of instructions that instruct a user how to connect the plurality of prearranged dots to reveal an image;

wherein the composed image forms a background or foreground for the image revealed by connecting the dots.

10. The 3D playing kit of claim 9, further comprising one or more soft black pencils, an eraser and a pencil sharpener.

11. The 3D playing kit of claim 9, further comprising marker of colors for filing colors in an image revealed by connecting the dots.

12. The 3D playing kit of claim 9, wherein the book includes at least one fold-out sheet.

13. The 3D playing kit of claim 9, wherein a cover of the book and a front surface of the colored filter glasses contain a same design pattern.

14. The 3D playing kit of claim 9, wherein the set of instructions instruct a user to connect the dots with a temporary marking device according to the predetermined sequence indicated by the indicia, thereby revealing the image, trace over the outline with the permanent marking device to complete the image; and wear the pair of colored filter glasses to view 3D effects of the 3D playing kit.

15. The 3D playing kit of claim 9, wherein when viewed, the image revealed by connecting the dots has a different distance with respect to the at least one of the plurality of playing surfaces than the composed image.

* * * * *